US005079537A

United States Patent [19]

Quinn et al.

[11] Patent Number: 5,079,537

[45] Date of Patent: Jan. 7, 1992

[54] APPARATUS FOR ASSEMBLING AND HOLDING A POTENTIOMETER ASSEMBLY

[75] Inventors: John D. Quinn, Hudson, N.H.; Brian S. Siart, Fitchburg, Mass.

[73] Assignee: Digital Equipment Corporation, Maynard, Mass.

[21] Appl. No.: 696,323

[22] Filed: Apr. 30, 1991

Related U.S. Application Data

[63] Continuation of Ser. No. 403,893, Sep. 5, 1989, abandoned, which is a continuation of Ser. No. 83,697, Aug. 7, 1987, abandoned.

[51] Int. Cl.[5] ..... H01C 10/00

[52] U.S. Cl. ..... 338/197; 29/509; 248/27.1; 248/27.3

[58] Field of Search ..... 29/509, 610.1, 613, 29/617; 200/295, 296; 361/400; 248/27.1, 27.3; 439/544, 551, 556, 545, 546, 548, 55, 76; 338/197

[56] References Cited

U.S. PATENT DOCUMENTS

| | | | |
|---|---|---|---|
| 2,151,089 | 3/1939 | Douglas | 439/546 |
| 2,492,286 | 12/1949 | Hermann | 338/197 |
| 2,639,358 | 5/1953 | Budd et al. | 338/197 |
| 2,654,641 | 10/1953 | Veatch et al. | 338/197 |
| 2,721,245 | 10/1955 | Arisman et al. | 338/197 |
| 3,368,779 | 2/1968 | Connine | 248/27.1 |
| 3,376,871 | 4/1968 | Baker | 248/27.1 |
| 3,519,974 | 7/1970 | Havenstine | 338/197 |
| 3,631,376 | 12/1971 | Halfaker | 248/27.1 |
| 4,029,953 | 6/1977 | Natoli | 439/546 |
| 4,427,255 | 1/1984 | Cox | 439/548 |
| 4,679,025 | 7/1987 | Ohashi | 338/197 |

FOREIGN PATENT DOCUMENTS

| | | | |
|---|---|---|---|
| 748061 | 12/1966 | Canada | 338/197 |
| 756635 | 9/1956 | United Kingdom | 338/197 |

*Primary Examiner*—Irene Cuda
*Attorney, Agent, or Firm*—Kenyon & Kenyon

[57] ABSTRACT

A support plate for mounting one or more potentiometers includes a receptor for receiving a potentiometer and alignment tabs for guiding the potentiometer into position and preventing it from rotating during mounting. The potentiometer may be secured to the alignment plate through the application of clamping force produced by torquing a lock nut on the threaded stem of the potentiometer. The alignment tabs prevent the potentiometer from rotating during the application of the clamping force so that the contacts of the potentiometer maintain a predetermined position.

4 Claims, 1 Drawing Sheet

APPARATUS FOR ASSEMBLING AND HOLDING A POTENTIOMETER ASSEMBLY

This is a continuation of application Ser. No. 07/403,893, filed Sept. 5, 1989, which is a continuation of 07/083,697, filed Aug. 7, 1987, now abandoned.

BACKGROUND OF THE INVENTION

The present invention relates to a method and apparatus for forming an assembly of potentiometers.

Known methods of assembling potentiometers involve inserting the potentiometer through a support plate and then securing the potentiometer to the support plate. The means for securing the potentiometer to the support plate typically comprises an apparatus for absorbing clamping force such as produced by torquing a lock nut on a threaded stem of the potentiometer. However, the clamping force used to secure the potentiometer tends to rotate the potentiometer. The position of the contacts of the potentiometer thus shift erratically out of alignment and cannot readily connect to a printed circuit board. The rotation of the potentiometer against the support plate increases the time required to form a potentiometer assembly by requiring a separate step to realign the wires of the potentiometer. Moreover, the rotation may cause the contacts to become cross wired.

SUMMARY OF THE INVENTION

The present invention relates to a method and apparatus for securing a potentiometer against a support plate so that the potentiometer cannot rotate during assembly. A receptor receives the potentiometer at the support plate. Alignment tabs extend up from the support plate and prevent the potentiometer from rotating during assembly. The potentiometer is inserted between the alignment tabs before the clamping force secures the potentiometer to the support plate. The alignment tabs insure that the connecting wires to the potentiometer are correctly aligned in the potentiometer assembly and prevent the potentiometer from rotating during the application of the clamping force. The connections to the potentiometer thus assume a known location that can correspond to a predetermined point of connection on a printed circuit board. The invention has particular utility for mounting a plurality of potentiometers in a single assembly.

DETAILED DESCRIPTION OF THE PREFERRED EMBODIMENT

Figure 1:
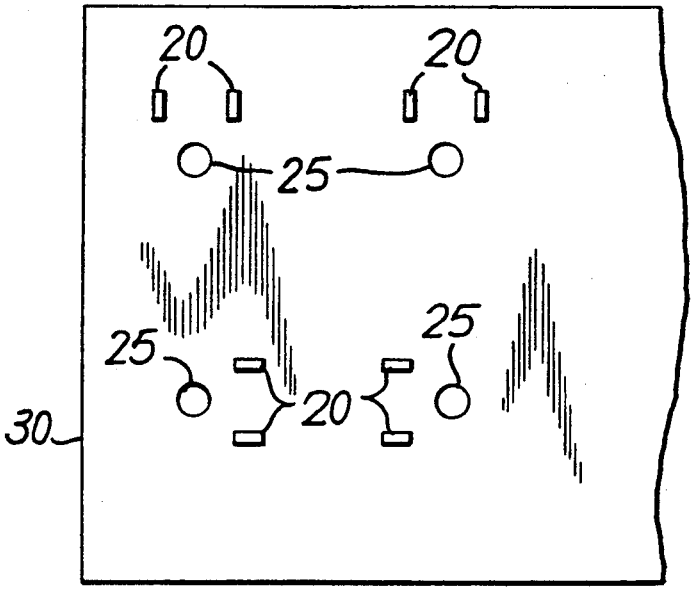
FIG. 1 shows a support plate according to the present invention for receiving a plurality of potentiometers.

FIG. 1 shows a support plate according to the present invention for receiving four potentiometers. Mounting holes 25 are apertures in support plate 30 that function as receptors for receiving the potentiometers. Alignment tabs 20 extend out of the page. The relative height of alignment tabs 20 above support plate 30 depends on the relative size of the potentiometers. The support tabs should extend a sufficient distance above support plate 30 so that the potentiometers cannot rotate over the alignment tabs during clamping.

Figure 2:
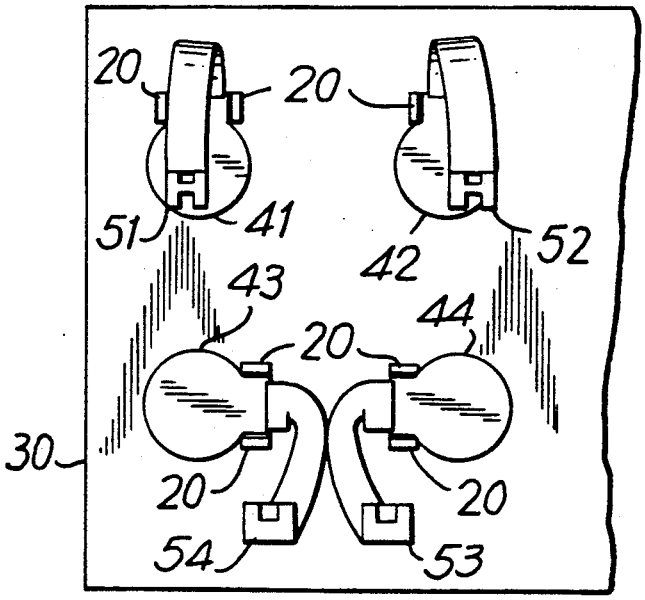
FIG. 2 shows a support plate shown in FIG. 1 with the potentiometers mounted in place.

FIG. 2 shows the support plate shown in FIG. 1 with potentiometers 41–44 mounted in their predetermined position. The potentiometers comprise contacts 51–54 that may be connected to a printed circuit board, not shown. Alignment tabs 20 maintain the potentiometers in place so that the contacts remain aligned without regard to the direction of application of the clamping force.

Each potentiometer is secured to the support plate with clamping force generated by torquing a lock nut against a threaded stem of the potentiometer on the backside of the mounting plate shown in FIGS. 1 and 2. Clamp mounted potentiometers are known in the art and therefore not described in detail.

The principles, preferred embodiments and modes of operation of the present invention have been described in the foregoing specification. The invention which is intended to be protected herein should not however, be construed as limited to the particular forms described as these are to be regarded as illustrative rather than restrictive. Variations and changes may be made by those skilled in the art without departing from the spirit of the invention. Accordingly, the foregoing detailed description should be considered exemplary in nature and not as limiting to the scope and spirit of the invention set forth in the appended claims.

What is claimed is:

1. A system for mounting and holding a potentiometer, comprising:

a support plate for mounting the potentiometer thereon, the support plate further having a potentiometer receiving means into which a predetermined first section of the potentiometer extends;

a pair of alignment tabs that extend from the support plate substantially normal thereto, with the alignment tabs being positioned adjacent each other next to the potentiometer receiving means for receiving therebetween a predetermined second section of the potentiometer for establishing a predetermined orientation for alignment of the potentiometer in the potentiometer receiving means before the potentiometer is secured, during a time when the potentiometer is being secured, and after the potentiometer is secured to the support plate; and securing means for immovably securing the potentiometer to the support plate.

2. The system as recited in claim 1, wherein the support plate includes a plurality of potentiometer receiving means, with each potentiometer receiving means having a predetermined first section of a potentiometer extending therethrough, and with each potentiometer receiving means having associated with it a pair of alignment tabs, each pair of alignment tabs for receiving therebetween a predetermined second section of the potentiometer for establishing a predetermined orientation of a potentiometer.

3. A system for mounting at least one potentiometer, comprising:

a support plate that further includes, first and second upstanding members extending from a first surface of the support plate for receiving therebetween and engaging portions of a peripheral surface of the potentiometer, and potentiometer receiving means for receiving at least a portion of the potentiometer therein, with the potentiometer receiving means, the first and second upstanding members, and a securing means acting cooperatively to prevent rotational movement of the potentiometer in a predetermined direction about a predetermined point before the potentiometer is secured, during a time when the potentiometer is being secured, and after the potentiometer is secured to the support plate; and securing means for immovably securing the potentiometer to the support plate.

4. A system for mounting a plurality of potentiometers, with each site for mounting a potentiometer comprising:

a support plate that further includes, first and second upstanding members extending from a first surface of the support plate for receiving therebetween and engaging portions of a peripheral surface of the potentiometer, and potentiometer receiving means for receiving at least a portion of a potentiometer therein, with the potentiometer receiving means, the first and second upstanding members, and a securing means acting cooperatively to prevent rotational movement of the potentiometer in a predetermined direction about a predetermined point before the potentiometer is secured, during a time when the potentiometer is being secured, and after the potentiometer is secured to the support plate; and securing means for immovably securing the potentiometer to the support plate.

* * * * *